US010084241B1

(12) United States Patent
Jenwatanavet et al.

(10) Patent No.: US 10,084,241 B1
(45) Date of Patent: Sep. 25, 2018

(54) DUAL-POLARIZATION ANTENNA SYSTEM

(71) Applicant: QUALCOMM Incorporated, San Diego, CA (US)

(72) Inventors: Jatupum Jenwatanavet, San Diego, CA (US); Mohammad Ali Tassoudji, San Diego, CA (US); Joe Le, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/903,369

(22) Filed: Feb. 23, 2018

(51) Int. Cl.
*H01Q 21/24* (2006.01)
*H01Q 1/24* (2006.01)
*H01Q 21/29* (2006.01)

(52) U.S. Cl.
CPC ..... *H01Q 21/24* (2013.01); *H01Q 1/243* (2013.01); *H01Q 21/29* (2013.01)

(58) Field of Classification Search
CPC ..... H01Q 21/24; H01Q 21/29; H01Q 1/24; H01Q 1/243
See application file for complete search history.

(56) References Cited

U.S. PATENT DOCUMENTS 8,570,229 B2 * 10/2013 Yoon ..... H01Q 1/243 343/727
8,988,298 B1 * 3/2015 Akhoondzadehasl ..... H01Q 21/00 343/700 MS
9,306,291 B2 4/2016 Lu et al.
9,490,542 B1 * 11/2016 Prinsloo ..... H01Q 9/16
2011/0287731 A1 * 11/2011 Hase ..... H01Q 9/16 455/269
2013/0082893 A1 4/2013 Wang et al.
2015/0214633 A1 7/2015 Pan
2016/0285175 A1 * 9/2016 Juan ..... H01Q 21/26
2017/0033810 A1 2/2017 Crouch et al.
2017/0077614 A1 3/2017 Lin et al.
2017/0149145 A1 * 5/2017 Payne ..... H01Q 21/26
2018/0026341 A1 * 1/2018 Mow ..... H01Q 1/2291 343/702

FOREIGN PATENT DOCUMENTS

GB 2512111 A * 9/2014 ..... H01Q 9/16

* cited by examiner

*Primary Examiner* — Hoang Nguyen
(74) *Attorney, Agent, or Firm* — Hunter Clark PLLC; Hunter Clark

(57) ABSTRACT

A method of sending and receiving dual-polarization, millimeter-wave signals to and from a mobile device having a top surface, a bottom surface, and an edge surface, includes: radiating energy, in a millimeter-wave frequency band, from a first radiator outwardly from the edge surface with a first polarization; receiving, via the first radiator, energy in the millimeter-wave frequency band with the first polarization; radiating energy, in the millimeter-wave frequency band, from a second radiator outwardly from the edge surface with a second polarization substantially perpendicular to the first polarization, the second radiator being disposed between the first radiator and the top surface or the bottom surface, or a combination thereof; and receiving, via the second radiator, energy in the millimeter-wave frequency band with the second polarization.

30 Claims, 8 Drawing Sheets

FIG. 5
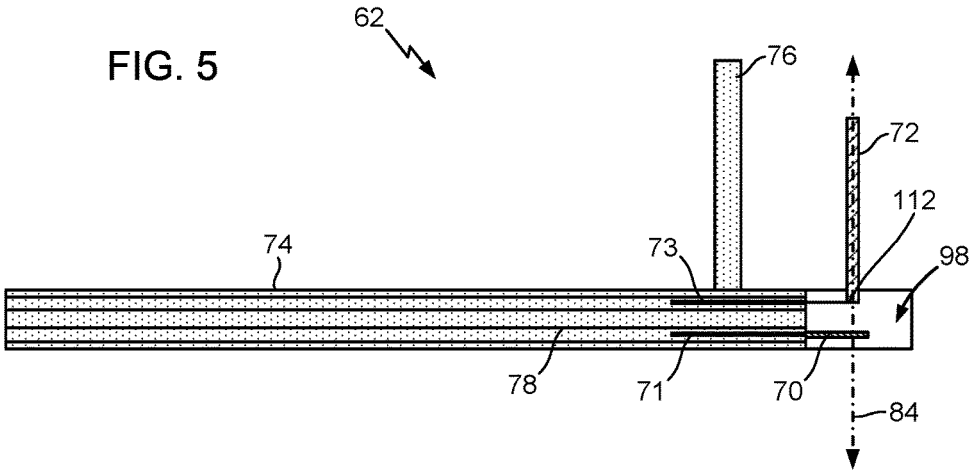
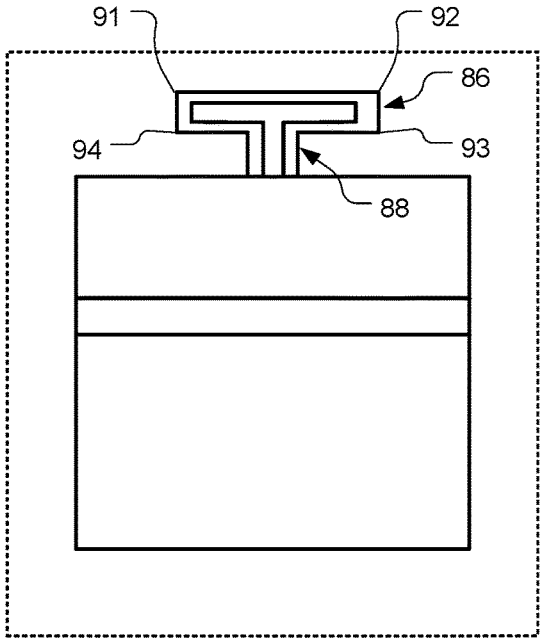
FIG. 6

DUAL-POLARIZATION ANTENNA SYSTEM

BACKGROUND

Wireless communication devices are increasingly popular and increasingly complex. For example, mobile telecommunication devices have progressed from simple phones, to smart phones with multiple communication capabilities (e.g., multiple cellular communication protocols, Wi-Fi, BLUETOOTH® and other short-range communication protocols), supercomputing processors, cameras, etc. Wireless communication devices have antennas to support cellular communication over a range of frequencies.

It is often desirable to have communication technologies at specific frequencies, and/or at frequencies that facilitate meeting various design criteria such as communication quality and/or antenna system size. Antenna systems that use millimeter-wave frequencies may provide high-quality communication in a small form factor.

SUMMARY

An example dual-polarization, millimeter-wave antenna system in a mobile device having a top surface, a bottom surface, and an edge surface, includes: a first antenna element configured to radiate energy, in a millimeter-wave frequency band, outwardly from the edge surface with a first polarization; a second antenna element configured to radiate energy, in the millimeter-wave frequency band, outwardly from the edge surface with a second polarization substantially perpendicular to the first polarization; and a front-end circuit coupled to the first antenna element and the second antenna element and configured to provide first outbound signals to the first antenna element for radiation, to provide second outbound signals to the second antenna element for radiation, to receive first inbound signals from the first antenna element, and to receive second inbound signals from the second antenna element; where the second antenna element is disposed between the first antenna element and the top surface, or between the first antenna element and the bottom surface, or between the first antenna element and the top surface and between the first antenna element and the bottom surface.

Implementations of such a system may include one or more of the following features. A longitudinal axis of the second antenna element, parallel to the second polarization, intersects with an area occupied by the first antenna element. The first antenna element is a dipole and the second antenna element is a monopole. A projection of the monopole along a length of the monopole is centered over a radiating-arms portion of the dipole. The antenna system further includes a reflecting ground wall disposed inwardly from the monopole relative to the edge surface and configured to reflect energy radiated inwardly from the monopole. The antenna system further includes an isolating ground plane disposed between a monopole feed, configured and coupled to convey energy to the monopole, and a dipole feed, configured and coupled to convey energy to the dipole. The monopole feed, the dipole feed, and the isolating ground plane are each disposed in a respective layer of a printed circuit board. The dipole and the monopole comprise portions of a stepped member, the stepped member including a printed circuit board, with the dipole extending from an edge of a ground plane of the printed circuit board, and a stepped section, with the monopole disposed in the stepped section and extending away from the dipole. The stepped member further includes a ground wall disposed substantially parallel to the monopole.

Another example dual-polarization, millimeter-wave antenna system in a mobile device having a top surface, a bottom surface, and an edge surface, includes: first radiating means for radiating energy, in a millimeter-wave frequency band, outwardly from the edge surface with a first polarization; second radiating means for radiating energy, in the millimeter-wave frequency band, outwardly from the edge surface with a second polarization substantially perpendicular to the first polarization; and radio-frequency circuit means, coupled to the first radiating means and the second radiating means, for providing first outbound signals to the first radiating means for radiation, for providing second outbound signals to the second radiating means for radiation, for receiving first inbound signals from the first radiating means, and for receiving second inbound signals from the second radiating means; where the second radiating means are disposed between the first radiating means and the top surface, or between the first radiating means and the bottom surface, or between the first radiating means and the top surface and between the first radiating means and the bottom surface.

Implementations of such a system may include one or more of the following features. The first radiating means include a dipole and the second radiating means include a monopole. A projection of the monopole along a length of the monopole is centered over a radiating-arms portion of the dipole. The antenna system further includes reflecting means, disposed inwardly from the monopole relative to the edge surface, for reflecting energy radiated inwardly from the monopole. The antenna system further includes isolating means for inhibiting electrical coupling between a first feed for the first radiating means, configured and coupled to convey energy to the first radiating means, and a second feed for the second radiating means, configured and coupled to convey energy to the second radiating means. The first feed for the first radiating means, the second feed for the second radiating means, and the isolating means are each disposed in a respective layer of a printed circuit board.

An example method of sending and receiving dual-polarization, millimeter-wave signals to and from a mobile device having a top surface, a bottom surface, and an edge surface, includes: radiating energy, in a millimeter-wave frequency band, from a first radiator outwardly from the edge surface with a first polarization; receiving, via the first radiator, energy in the millimeter-wave frequency band with the first polarization; radiating energy, in the millimeter-wave frequency band, from a second radiator outwardly from the edge surface with a second polarization substantially perpendicular to the first polarization, the second radiator being disposed between the first radiator and the top surface or the bottom surface, or a combination thereof; and receiving, via the second radiator, energy in the millimeter-wave frequency band with the second polarization.

Implementations of such a method may include one or more of the following features. The method further includes isolating a first feed conveying energy to or from the first radiator from a second feed conveying energy to or from the second radiator.

An example dual-polarization, millimeter-wave antenna system includes: a printed circuit board comprising a substantially planar portion having a length, a width, and a thickness, each of the length and the width being at least two times the thickness; a dipole extending from a ground plane of the printed circuit board and configured to radiate energy. in a millimeter-wave frequency band. outwardly from an edge of the printed circuit board with a first polarization substantially parallel to a plane defined by the length and the width of the printed circuit board; and a monopole extending in a direction non-parallel to the plane defined by the length and the width of the printed circuit board, the monopole configured to radiate energy, in the millimeter-wave frequency band, outwardly from the printed circuit board with a second polarization non-parallel to the first polarization.

Implementations of such a system may include one or more of the following features. A longitudinal axis of the monopole intersects with an area of the dipole. A projection of the monopole along a length of the monopole overlaps with area occupied by a radiating-arms portion of the dipole. The projection of the monopole along the length of the monopole is centered over the radiating-arms portion of the dipole. The antenna system further includes a reflecting ground wall disposed inwardly from the monopole relative to an edge of the printed circuit board and configured to reflect energy radiated from the monopole. The antenna system further includes: a monopole feed, configured and coupled to convey energy to the monopole; a dipole feed, configured and coupled to convey energy to the dipole; and an isolating ground plane disposed between the monopole feed and the dipole feed. The printed circuit board includes a stepped portion extending away from the substantially planar portion, the stepped portion comprising at least part of the monopole. The at least part of the monopole includes vias through respective layers of the stepped portion of the printed circuit board. The monopole extends in a direction substantially transverse to the plane defined by the length and the width of the printed circuit board. The second polarization is substantially perpendicular to the first polarization. The monopole is substantially linear. The monopole is helical. The monopole and the dipole are collocated when viewed from a first direction substantially transverse to the plane defined by the length and the width of the printed circuit board, the monopole and the dipole being spaced apart along the first direction.

BRIEF DESCRIPTION OF THE DRAWINGS

FIG. 5 is a side view of the antenna system shown in FIG. 4.

FIG. 6 is a top view of the antenna system shown in FIG. 4.

DETAILED DESCRIPTION

Techniques are discussed herein for communicating in at millimeter-wave frequencies with a wireless communication device. For example, a dipole radiator, such as a differential dipole radiator, may be provided for sending and receiving edge-directed horizontal-polarization signals and a monopole may be provided for sending and receiving edge-directed vertical-polarization signals. The dipole radiator may be disposed in one layer of a multi-layer printed circuit board (PCB) while the monopole radiator may be fed in a different layer of the PCB and may extend externally to the PCB. Alternatively, the monopole radiator may be disposed completely in the PCB, with a feed being in a layer of the PCB and the monopole radiator being formed through multiple layers of the PCB. Alternatively still, the monopole radiator may be formed in a layer of a PCB that is attached to the PCB containing the dipole radiator and a feed of the monopole radiator. Other configurations, however, may be used.

Items and/or techniques described herein may provide one or more of the following capabilities, as well as other capabilities not mentioned. A dual-polarization antenna system may be provided with good isolation between different polarization signals at the same frequency. A dual-polarization antenna system may be provided with a small form factor. Dual-polarization, edge-fired, millimeter-wave communication signals can be provided from a printed circuit board, e.g., from a combination of a dipole radiator and a monopole radiator with isolated feeds. Dual polarization may help improve polarization diversity. Dual polarization may improve data rate, and thus throughput, by communicating different data using different polarizations. Other capabilities may be provided and not every implementation according to the disclosure must provide any, let alone all, of the capabilities discussed. Further, it may be possible for an effect noted above to be achieved by means other than that noted, and a noted item/technique may not necessarily yield the noted effect.

Figure 1:
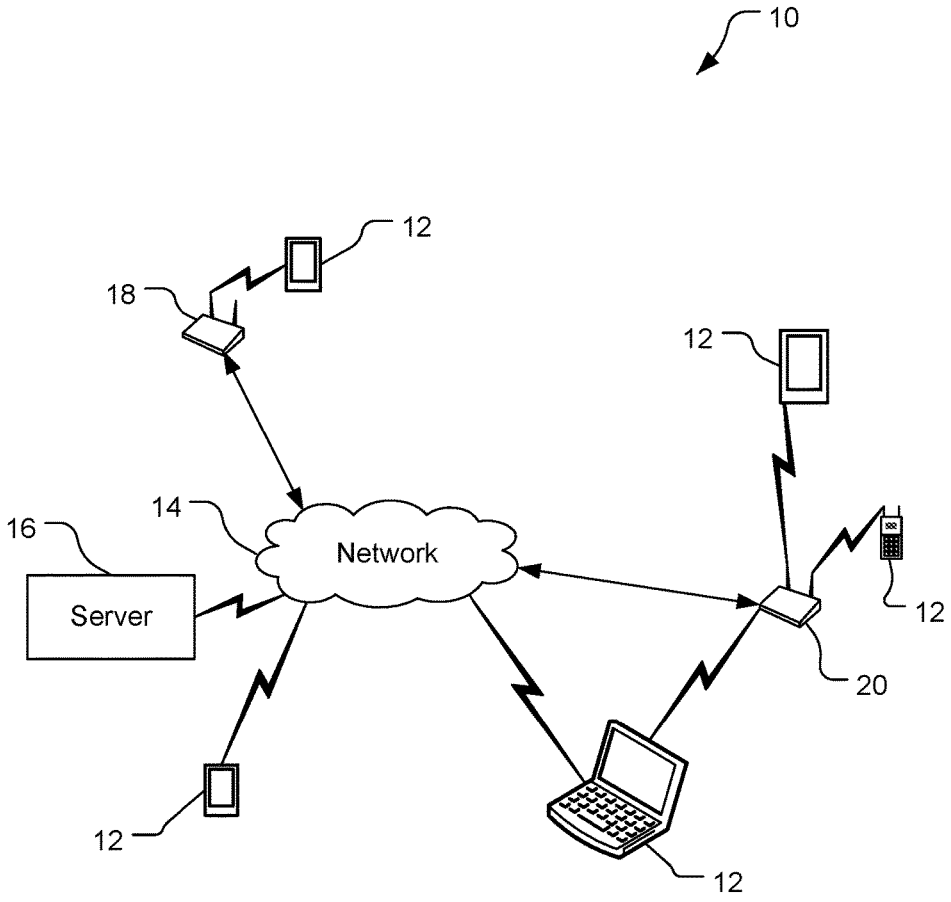
FIG. 1 is a schematic diagram of a communication system.

Referring to FIG. 1, a communication system 10 includes mobile devices 12, a network 14, a server 16, and access points (APs) 18, 20. The system 10 is a wireless communication system in that components of the system 10 can communicate with one another (at least some times using wireless connections) directly or indirectly, e.g., via the network 14 and/or one or more of the access points 18, 20 (and/or one or more other devices not shown, such as one or more base transceiver stations). For indirect communications, the communications may be altered during transmission from one entity to another, e.g., to alter header information of data packets, to change format, etc. The mobile devices 12 shown are mobile wireless communication devices (although they may communicate wirelessly and via wired connections) including mobile phones (including smartphones), a laptop computer, and a tablet computer. Still other mobile devices may be used, whether currently existing or developed in the future. Further, other wireless devices (whether mobile or not) may be implemented within the system 10 and may communicate with each other and/or with the mobile devices 12, network 14, server 16, and/or APs 18, 20. For example, such other devices may include internet of thing (IoT) devices, medical devices, home entertainment and/or automation devices, etc. The mobile devices 12 or other devices may be configured to communicate in different networks and/or for different purposes (e.g., 5G, Wi-Fi communication, multiple frequencies of Wi-Fi communication, satellite positioning, one or more types of cellular communications (e.g., GSM (Global System for Mobiles), CDMA (Code Division Multiple Access), LTE (Long-Term Evolution), etc.).

Figure 2:
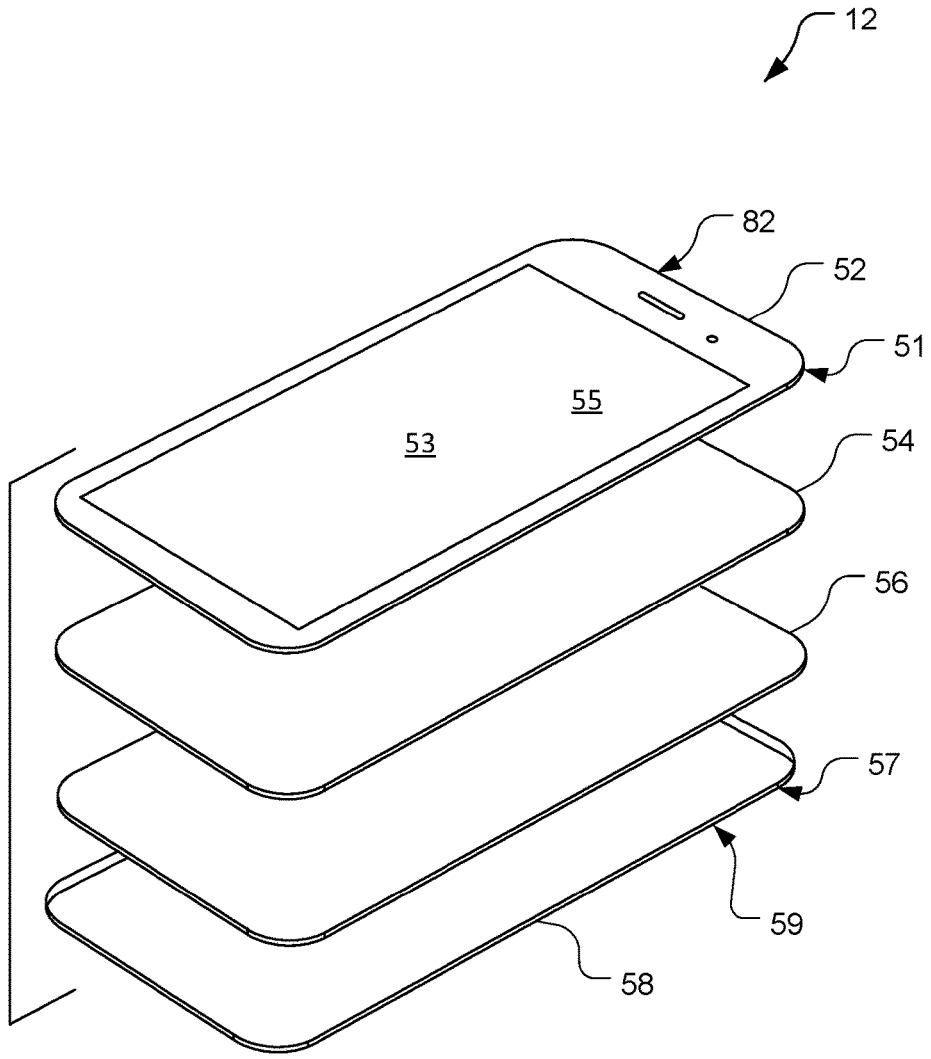
FIG. 2 is an exploded perspective view of simplified components of a mobile device shown in FIG. 1.

Referring to FIG. 2, an example of one of the mobile devices 12 shown in FIG. 1 includes a top cover 52, a display 54, a printed circuit board (PCB) 56, and a bottom cover 58. The mobile device 12 as shown may be a smartphone or a tablet computer but the discussion is not limited to such devices. The top cover 52 includes a screen 53 that is planar. The screen 53 is planar in that at least part of a top surface 55 of the screen 53 is planar, although the entirety of the screen 53 may not be planar, e.g., may have one or more curved sides. The PCB 56 includes one or more antennas configured to facilitate bi-directional communication between mobile device 12 and one or more other devices, including other wireless communication devices. The bottom cover 58 has a bottom surface 59 and sides 51, 57 of the top cover 52 and the bottom cover 58 provide an edge surface. The top cover 52 and the bottom cover 58 comprise a housing that retains the display 54, the PCB 56, and other components of the mobile device 12 that may or may not be on the PCB 56. For example, the housing may retain (e.g., hold, contain) antenna systems, front-end circuits, an intermediate-frequency circuit, and a processor discussed below. The housing is substantially rectangular, having two sets of parallel edges. In this example, the housing has rounded corners, although the housing may be substantially rectangular with other shapes of corners, e.g., straight-angled (e.g., 45°) corners, 90°, other non-straight corners, etc. Further, the size and/or shape of the PCB 56 may not be commensurate with the size and/or shape of either of the top or bottom covers or otherwise with a perimeter of the device. For example, the PCB 56 may have a cutout to accept a battery. Those of skill in the art will therefore understand that embodiments of the PCB 56 other than those illustrated may be implemented.

Figure 3:
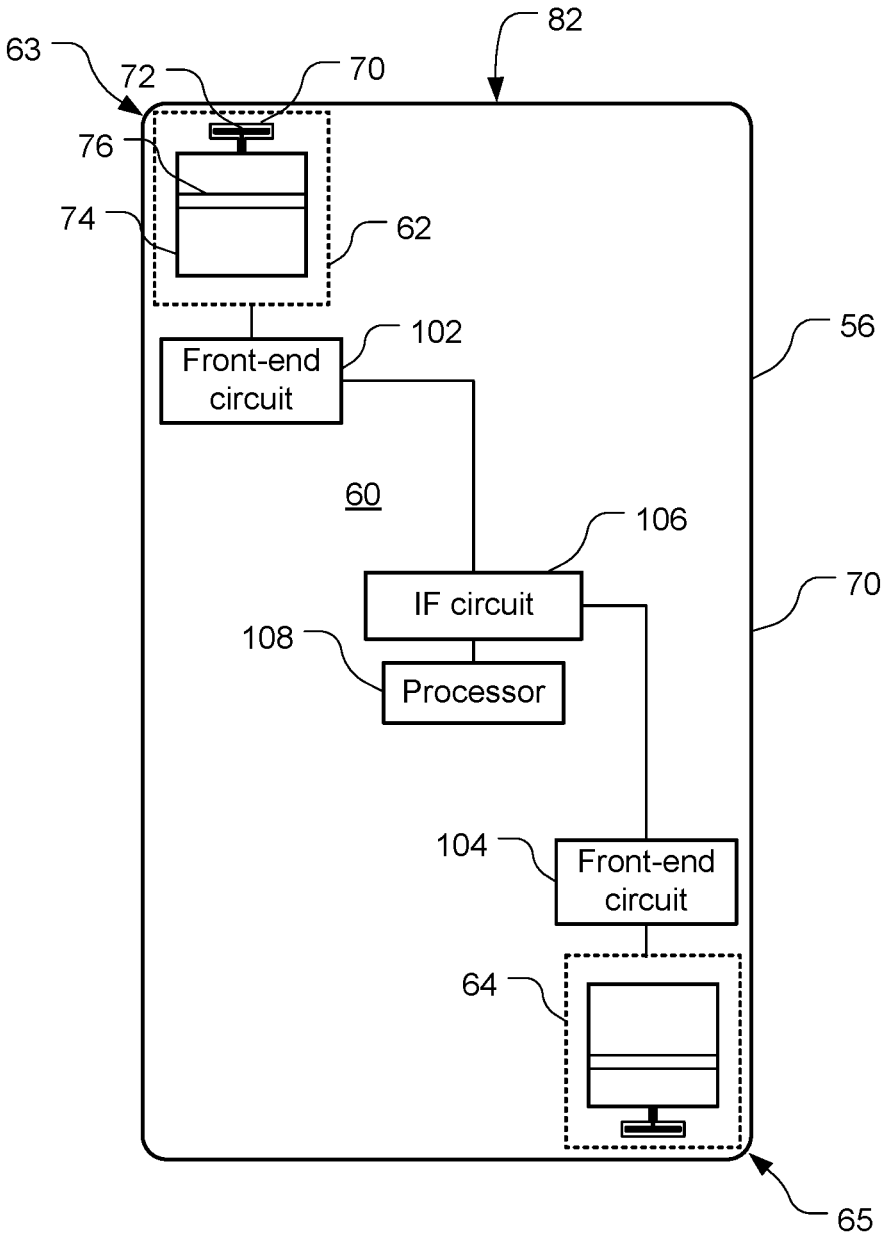
FIG. 3 is a top view of a printed circuit board, shown in FIG. 2, including antenna systems.

Referring also to FIG. 3, an example of the PCB 56 includes a main portion 60 and two antenna systems 62, 64. In the example shown, the antennas 62, 64 are disposed in diagonally-opposite corners 63, 65 of the PCB 56, and thus, in this example, of the mobile device 12 (e.g., of the housing of the mobile device 12). The main portion 60 includes front-end circuits 102, 104 (also called a radio frequency (RF) circuit), an intermediate-frequency (IF) circuit 106, and a processor 108. The front-end circuits 102, 104 are configured to provide outbound signals to the antenna systems 62, 64 for the antenna systems 62, 64 to radiate, and to receive and process inbound signals that are received by, and provided to the front-end circuits 102, 104 from, the antenna systems 62, 64. The front-end circuits 102, 104 are configured to convert received IF signals from the IF circuit 106 to RF signals (amplifying with a power amplifier as appropriate), and provide the RF signals to the antenna systems 62, 64 for radiation. The front-end circuits 102, 104 are configured to convert RF signals received by the antenna systems 62, 64 to IF signals (e.g., using a low-noise amplifier and a mixer) and to send the IF signals to the IF circuit 106. The IF circuit 106 is configured to convert IF signals received from the front-end circuits 102, 104 to baseband signals and to provide the baseband signals to the processor 108. The IF circuit 106 is also configured to convert baseband signals provided by the processor to IF signals, and to provide the IF signals to the front-end circuits 102, 104. The processor 108 is communicatively coupled to the IF circuit 106, which is communicatively coupled to the front-end circuits 102, 104, which are communicatively coupled to the antenna systems 62, 64, respectively. The processor 108 includes appropriate circuitry and memory to perform functions including performing calculations and producing instructions and signals. The memory is a non-transitory, processor-readable memory that stores appropriate software instructions that may be executed (directly and/or after compiling) by the processor 108 to perform functions of the processor 108.

The antenna systems 62, 64 may be formed as part of the PCB 56 in a variety of manners. For example, the antenna systems 62, 64 may be integral with a board, e.g., a dielectric board or a semiconducting board, of the PCB 56, being formed as integral components of the board. In this case, the dashed lines around the antenna systems indicate functional separation of the antenna systems 62, 64 (and the components thereof) from other portions of the PCB 56. Alternatively, one or more components of the antenna system 62 and/or the antenna system 64 may be formed integrally with the board of the PCB 56, and one or more other components may be formed separate from the board and mounted to the board of (or otherwise made part of) the PCB 56. Alternatively, both of the antenna systems 62, 64 may be formed separately from the board of the PCB 56, mounted to the board and coupled to the front-end circuits 102, 104, respectively. In some examples, one or more components of the antenna system 62 may be integrated with the front-end circuit 102, e.g., in a single module or on a single circuit board. Also or alternatively, one or more components of the antenna system 64 may be integrated with the front-end circuit 104, e.g., in a single module or on a single circuit board.

Figure 9:
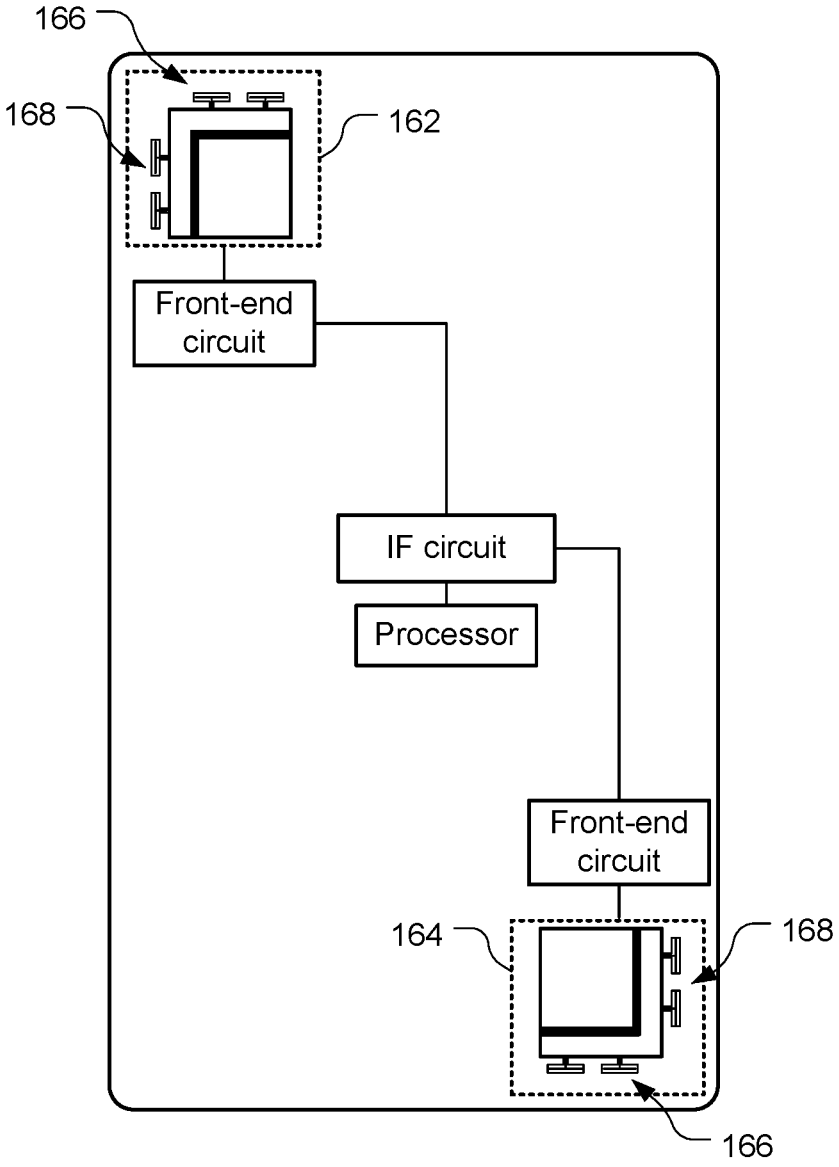
FIG. 9 is a top view of a printed circuit board with antenna systems each with two 1×2 arrays of radiators.

The antenna systems 62, 64 are configured similarly, here as dual-polarization, millimeter-wave antenna systems with multiple radiators to facilitate communication with other devices at various directions relative to the mobile device 12. The radiators are configured and disposed to be edge-fired radiators, to radiate signals outwardly from an edge of the mobile device 12. The multiple radiators are configured to transmit and receive signals with different polarizations, here vertical and horizontal polarizations relative to a plane of the PCB 56 (horizontal being in or parallel to a plane defined by the PCB 56 and vertical being perpendicular to the plane defined by the PCB 56) or substantially parallel to (e.g., within ±10° of) and substantially perpendicular to (90°±10° of) to the plane of the top surface 55 of the screen 53 (with the two polarizations substantially perpendicular to each other). In the example of FIG. 3, each of the antenna systems 62, 64 includes a dipole radiator 70 (which may be referred to herein as a dipole) and a monopole radiator 72 (which may be referred to herein as a monopole), as further shown, for example, in FIG. 4. In other examples, other types of radiators may be used. For example, instead of the dipole radiator 70, another form of radiator may be used such as an inverted-F radiator, a Wire-inverted-F-antenna radiator (WIFA), or a planar-inverted-F-antenna radiator (PIFA). Also or alternatively, instead of the monopole radiator 72, another form of radiator may be used such as a coil radiator, a loop radiator, a meander line radiator, or a patch radiator. While the monopole radiator 72 is illustrated as being substantially linear, other implementations may be used. For example, a helical monopole or a meander monopole may be implemented. Further, while the antenna systems 62, 64 each include only one combination of the radiators 70, 72, one or more antenna systems may include more than one radiator combination, e.g., two radiator combinations disposed to radiate signals toward, and receive signals from, different directions. For example, in the antenna system 62, one radiator combination could be directed upwardly (as shown in FIG. 3) and one radiator combination directed to the left and/or in the antenna system 62, one radiator combination could be directed downwardly (as shown in FIG. 3) and one radiator combination directed to the right. As another example, one or more of the antenna systems may include one or more arrays of radiator combinations. For example, as shown in FIG. 9, antenna systems 162, 164 include arrays 166, 168 of radiator combinations, with the arrays 166 in the antenna systems 162, 164 directed upwardly and downwardly, respectively, as shown in FIG. 9 and the arrays 168 in the antenna systems 162, 164 directed leftward and rightward, respectively, as shown in FIG. 9. In some such embodiments, adjacent radiators in the arrays 166, 168 are separated by approximately a half wavelength of the frequency at which the radiators in the arrays 166, 168 are configured to transmit and/or receive.

Figure 4:
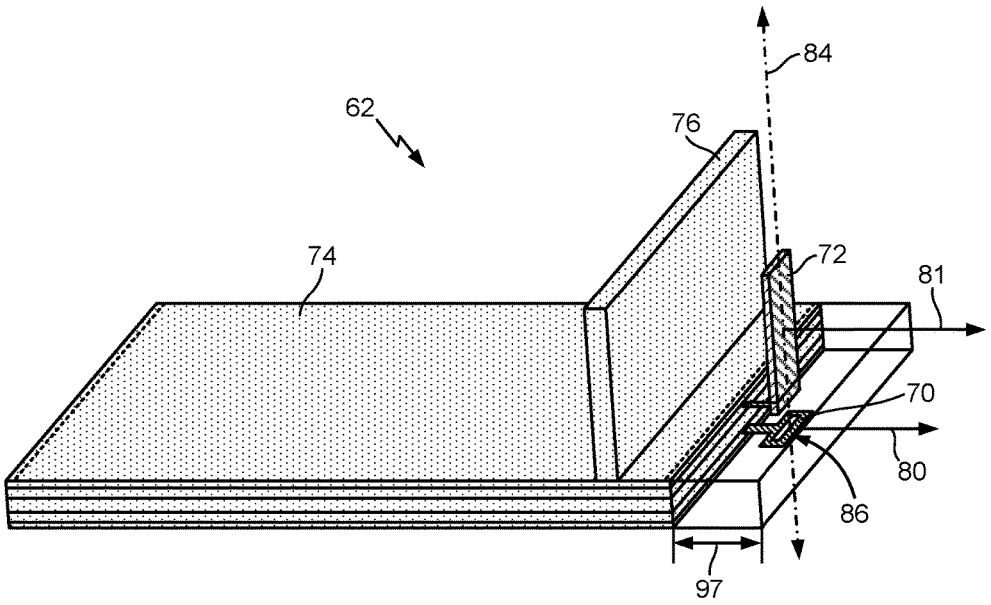
FIG. 4 is a perspective view of one of the antenna systems shown in FIG. 3, including a dipole radiator and a monopole radiator.

Referring to FIGS. 4-6, with further reference to FIGS. 1-3, the antenna system 62 includes a portion 74 of the PCB 56, a ground wall 76, the dipole 70, and the monopole 72. The dipole 70 is configured to radiate energy with a horizontal polarization, as shown parallel to a plane of a top surface of the portion 74 of the PCB 56 and parallel to a plane of the dipole 70. The dipole 70 may, for example, be a differential dipole. The dipole 70 is configured to radiate energy with a main beam 80 directed away from the portion 74 of the PCB 56, outwardly through a side of the mobile device 12 through and away from an edge surface 82 (FIGS. 2-3) of the mobile device 12. The monopole 72 is configured to radiate energy with a vertical polarization, as shown perpendicular to the plane of the top surface of the portion 74 of the PCB 56. Thus, the monopole 72 is configured and disposed relative to the dipole 70 such that the polarization of the energy radiated by the monopole 72 is perpendicular to the polarization of the energy radiated by the dipole 70 (and similarly for energy received by the monopole 72 and energy received by the dipole 70). The monopole 72 is configured to radiate energy with a main beam 81 directed away from the portion 74 of the PCB 56, outwardly through a side of the mobile device 12 through and away from the edge surface 82 (FIGS. 2-3) of the mobile device 12. In the example shown in FIG. 3, the main beam 81 is indicated by a line coming out of the monopole 72, but the main beam 81 will span non-zero angular widths, and the arrow is indicative of an example of a direction of a center of the main beam, although the center of the main beam may not point perpendicularly to a surface of the monopole 72.

The dipole 70 is collocated with the monopole 72 in the antenna system 62. A footprint, i.e., a projection of the monopole 72 downwardly, i.e., along a length (e.g., along a longitudinal axis 84) of the monopole 72 toward a bottom of the mobile device 12, overlaps the dipole 70 in the example shown. In other examples, the projection of the monopole 72 may not overlap with the dipole 70. In the example shown, the longitudinal axis 84 is parallel to the polarization of the energy radiated by the monopole 72 and intersects an area occupied by the dipole 70. In this example, the monopole 72 is centered over the dipole 70, with the projection of the monopole 72 and the longitudinal axis 84 being centered over and overlapping a radiating-arms portion 86 of the dipole 70, which may help conserve space within the mobile device 12. The monopole 72 (or other vertically-polarized radiator) may be located off-center relative to the dipole 70 (or other horizontally-polarized radiator), although being centered over the dipole 70 may yield better performance. The respective area of, or occupied by, the dipole 70, or the radiating-arms portion 86 may not be solid (occupied completely by metal) or completely enclosed, but includes the area that would be enclosed if a perimeter of the dipole 70, or of the radiating-arms portion 86, respectively, was complete, e.g., exterior borders were contiguous. For example, the area of the radiating-arms portion 86 is the area within the four corners 91, 92, 93, 94 of the radiating-arms portion 86 shown in FIG. 6. The dipole 70 is disposed adjacent to the monopole 72, with the dipole 70 extending from an edge of a ground plane of the PCB 56, and the monopole 72 extending away from the dipole 70, e.g., extending outside of the PCB 56 (FIG. 4), or from a top of the PCB 56, or even extending from another layer of the PCB 56 upwardly but within the PCB 56. The dipole 70 may be disposed in (e.g., printed in) the PCB 56 or may extend from the PCB 56 (e.g., being a stamped piece of metal). While embodiments are illustrated in which the monopole 72 is perpendicular to the portion 74, other embodiments may include a monopole which extends in a direction which is neither parallel to nor perpendicular to the portion 74. In such embodiments, the monopole may radiate with a polarization that is non-parallel to the polarization of the dipole 70.

Although the top surface 55 of the mobile device 12 is not shown in FIGS. 4-5, the monopole 72 is disposed between the dipole 70 and the top surface 55. Alternatively, the monopole 72 may be disposed between the dipole 70 and the bottom surface 59. Alternatively still, a vertical-polarization radiator could be disposed partially above a horizontal-polarization radiator (e.g., the dipole 70) and partially below the horizontal-polarization radiator, with the vertical-polarization radiator disposed between the horizontal-polarization radiator and the top surface 55 and between the horizontal-polarization radiator and the bottom surface 59. In some such embodiments, the vertical-polarization radiator may comprise a dipole radiator having a portion above the horizontal-polarization radiator and a portion below. In some embodiments, both the portion of the vertical-polarization radiator above the horizontal-portion radiator and the portion below may be coupled to the PCB 56. In other embodiments, another PCB may be implemented substantially parallel to the PCB 56 and respective portions of the vertical-polarization radiator may extend from each PCB. In yet other embodiments in which another PCB is implemented substantially parallel to the PCB 56, a separate vertical-polarization radiator may extend from the other PCB on a side of the horizontal-polarization radiator opposite the monopole 72. Such separate vertical-polarization radiator may be collocated with the horizontal-polarization radiator, and/or may be aligned with the axis 84 or offset with respect thereto.

Returning to the example of FIGS. 4-5, the monopole 72 is disposed between the dipole 70 and the top surface 55, and a projection of the area of the dipole 70 (including the radiating-arms portion 86 and a feed portion 88) perpendicular to a plane of the dipole 70 toward the top surface 55 would intersect with the monopole 72. The monopole 72 may be considered to be disposed between the dipole 70 and the top surface 55 even if the projection of the area of the dipole 70 perpendicular to the top surface 55 would not intersect with the monopole 72, e.g., if an area nine times the size of the radiating-arms portion 86, with the same aspect ratio and centered on the radiating-arms portion, would intersect with the monopole 72. The monopole 72 could be further offset from the dipole although a size of the antenna system 62 may be increased. The monopole 72 may be disposed relative to the dipole 70 such that the dipole 70 cannot be projected to intersect with both the monopole 72 and the edge surface of the mobile device 12.

The ground wall 76 is a reflecting ground wall disposed and configured to reflect energy radiated by the monopole 72. The ground wall 76 is disposed inwardly in the mobile device 12 from the monopole 72 relative to the edge surface of the mobile device. The ground wall 76 is configured to reflect energy radiated inwardly (away from an edge of the mobile device 12 toward the inside of the mobile device 12) from the monopole 72 to then add to energy radiated outwardly from the monopole 72 (away from the inside of the mobile device 12 out of and away from the mobile device 12). The ground wall 76 extends vertically from a top of the PCB 56 above a top of the monopole 72, and extends horizontally the width of the portion 74 of the PCB 56, i.e., the width of the antenna system 62. The ground wall 76 may not extend the full width of an antenna system, and may be angled to present multiple reflecting surfaces facing multiple different directions, e.g., if more than one monopole 72 is present along one edge of the antenna system (e.g., see the antenna systems 162, 164 of FIG. 9).

As shown in FIG. 5, the dipole 70 is coupled to a dipole feed 71 and the monopole 72 is coupled to a monopole feed 73. The dipole feed 71 and the monopole feed 73 are disposed in (e.g., printed in) respective layers of the PCB 56 (e.g., layer 6 and layer 3, counting from the top of the PCB 56 down) and configured to convey signals to and from the dipole 70 and the monopole 72, respectively. An isolating ground plane 78 is disposed in the PCB 56 between the dipole feed 71 and the monopole feed 73 to inhibit electrical coupling of energy between the dipole feed 71 and the monopole feed 73. Thus, the term "isolating" is used herein to indicate a separation and inhibiting of electrical coupling, and not necessarily complete, 100% electrical isolation with no coupling between the dipole feed 71 and the monopole feed 73. The dipole 70 and the monopole 72 may share the isolating ground plane 78.

Components of the antenna system 62 may have various sizes. For example, the portion 74 of the PCB 56, and/or a ground plane (such as the isolating ground plane 78) may have a length and a width that are each at least two times a thickness of the PCB 56, e.g., with the length and width of the portion 74 being 15 mm each and the thickness being 1 mm. The reflecting ground wall 76 may extend above the portion 74 of the PCB 56 between about 1 mm and about 4 mm (e.g., about 2 mm in a dielectric and about 4 mm in air), and the monopole 72 may extend above the top surface of the portion 74 of the PCB 56 between about 0.5 mm and about 3 mm (e.g., about 1.5 mm in a dielectric and about 3 mm in air). The radiating-arms portion 86 of the dipole 70 may be about 3 mm wide (e.g., 2.95 mm wide). A width 97 (FIG. 4) of a low-dielectric-constant region 98 (FIG. 5) of the PCB 56 (or possibly an open (i.e., air) region) in which the dipole 70 is disposed may be about 2 mm.

Figure 7:
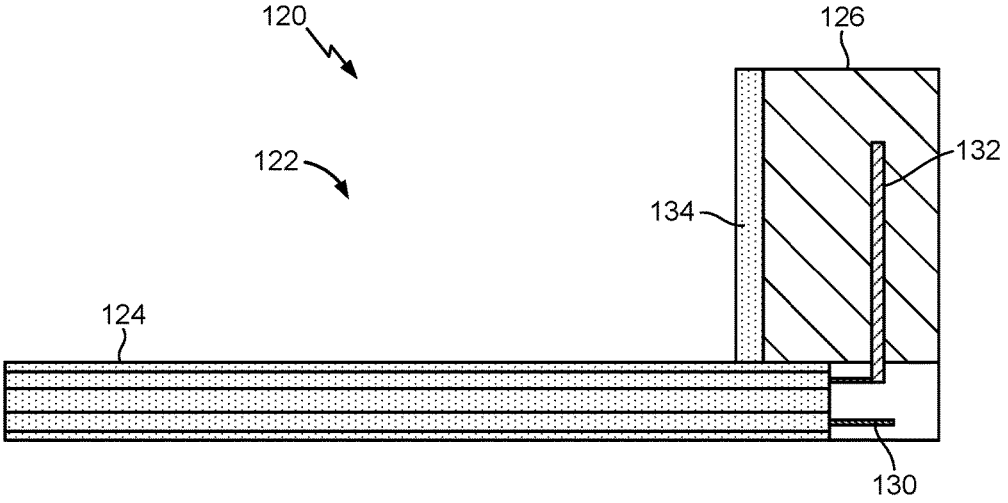
FIGS. 7-8 are top views of alternatively-constructed antenna systems.
Figure 8:
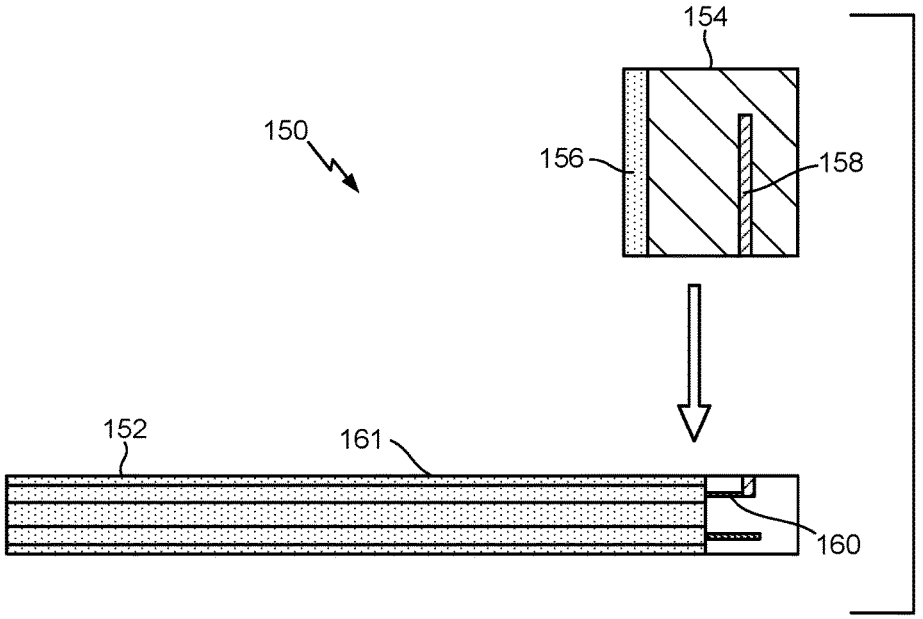

Antenna systems, such as the antenna system 62, may be constructed in a variety of manners. For the example of the antenna system 62 shown in FIG. 5, two separate metal pieces, one for the ground wall 76 and one for the monopole 72, may be attached to the PCB 56. The ground wall 76 could be soldered to a ground plane of the PCB 56 at the top of the PCB 56. The monopole 72 could be soldered to one or more plated via holes 112 in the PCB 56 extending upwardly from the feed 73. Referring to FIG. 7, an antenna system 120 includes a stepped PCB 122 that includes a flat section 124 (portion) and a stepped section 126 (portion). The flat section 124 is substantially planar (e.g., a top surface or a bottom surface having a variation from a planar surface that is less than a thickness of the flat section 124). The stepped section 126 extends away from the flat section 124 and includes a dipole 130, (at least part of) a monopole 132, and a reflecting ground wall 134. The monopole 132 and/or the ground wall 134 may be formed by plating, with conductive material, via holes through layers of a dielectric of the stepped section 126 of the PCB 122. Referring to FIG. 8, an antenna system 150 includes a PCB 152 and a PCB 154, with the PCB 154 including a reflecting ground wall 156 and a monopole 158 disposed in respective layers. The PCB 154 may be attached to the PCB 152 so that the monopole 158 will be coupled to a monopole feed 160 and the reflecting ground wall 156 coupled to a base ground plane 161. As another example, a monopole and a ground wall may be fabricated similarly to a capacitor chip or inductor chip, with the monopole and the ground wall fabricated in ceramic or another material as part of a chip. This chip could be mounted to a PCB containing a dipole using surface-mount technology (SMT) that is well-known in chip manufacturing.

Figure 10:
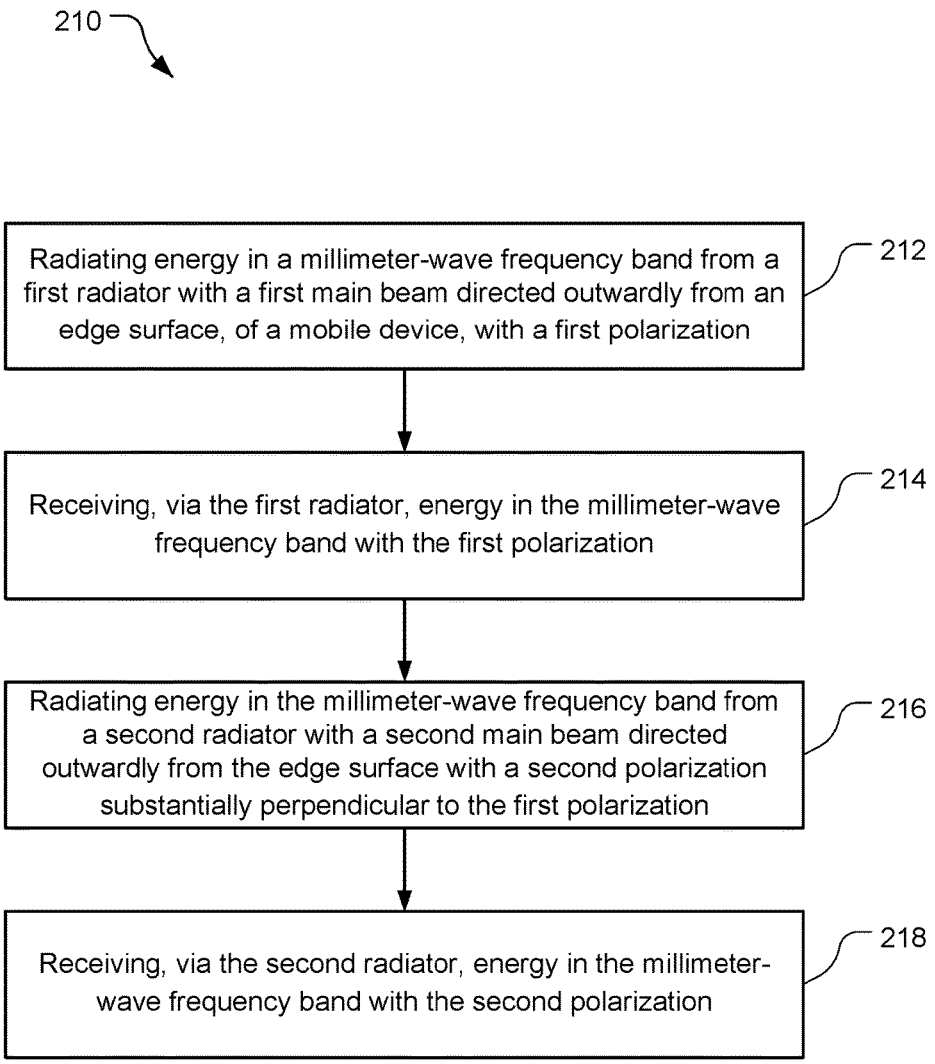
FIG. 10 is a block flow diagram of a method of sending and receiving dual-polarization, millimeter-wave signals to and from a mobile device.

Referring to FIG. 10, with further reference to FIGS. 1-6, a method 210 of sending and receiving dual-polarization, millimeter-wave signals to and from a mobile device includes the stages shown. The method 210 is, however, an example only and not limiting.

At stage 212, the method 210 includes radiating energy in a millimeter-wave frequency band from a first radiator with a first main beam directed outwardly from an edge surface, of a mobile device, with a first polarization. For example, the dipole 70 of the antenna system 62 radiates energy in a millimeter-wave frequency band (e.g., about 28 GHz, about 38 GHz, or another millimeter-wave frequency band). The dipole 70 radiates energy conveyed by the dipole feed 71 outwardly from the side of the mobile device 12, e.g., out of the side of the mobile device 12 along a top edge of the mobile device 12, with the main beam 80. The dipole 70 radiates this energy substantially parallel to the PCB 56 and substantially parallel to the plane of the screen 53. The energy provided to the dipole 70 comes from the processor 108 by way of the IF circuit 106 and the front-end circuit 102. The mobile device has a top surface, a bottom surface, and the edge surface and may be a mobile wireless communication device.

At stage 214, the method 210 includes receiving, via the first radiator, energy in the millimeter-wave frequency band with the first polarization. In addition to radiating energy from the dipole 70, the dipole 70 receives energy and provides a signal corresponding to a horizontally-polarized portion of the received energy to the dipole feed 71, that conveys the signal to the front-end circuit 102 for conversion and relay to the IF circuit 106 for conversion and relay to the processor 108 for appropriate processing.

At stage 216, the method 210 includes radiating energy in the millimeter-wave frequency band from a second radiator with a second main beam directed outwardly from the edge surface with a second polarization substantially perpendicular to the first polarization. The second radiator may be disposed between the first radiator and the top surface, or the bottom surface, or a combination thereof. As an example of stage 216, the monopole 72 of the antenna system 62 radiates energy in a millimeter-wave frequency band (e.g., about 28 GHz, about 38 GHz, or another millimeter-wave frequency band) with the main beam 81 substantially parallel to the main beam 80 from the dipole 70. The monopole 72 radiates energy conveyed by the monopole feed 73 outwardly from the side of the mobile device 12, e.g., out of the side of the mobile device 12 along a top edge of the mobile device 12. The monopole 72 radiates this energy with a polarization that is substantially perpendicular to the PCB 56, substantially perpendicular to the plane of the screen 53, and substantially perpendicularly to the polarization of the energy radiated by the dipole 70. The energy provided to the monopole 72 comes from the processor 108 by way of the IF circuit 106 and the front-end circuit 102.

At stage 218, the method 210 includes receiving, via the second radiator, energy in the millimeter-wave frequency band with the second polarization. In addition to radiating energy from the monopole 72, the monopole 72 receives energy and provides a signal corresponding to a vertically-polarized portion of the received energy to the monopole feed 73, that conveys the signal to the front-end circuit 102 for conversion and relay to the IF circuit 106 for conversion and relay to the processor 108 for appropriate processing.

The method 210 may include one or more other stages. For example, the method 210 may include isolating a first feed conveying energy to or from the first radiator from a second feed conveying energy to or from the second radiator. For example, the isolating ground plane 78 inhibits electrical coupling between the dipole feed 71 and the monopole feed 73.

OTHER CONSIDERATIONS

Also, as used herein, "or" as used in a list of items prefaced by "at least one of" or prefaced by "one or more of" indicates a disjunctive list such that, for example, a list of "at least one of A, B, or C," or a list of "one or more of A, B, or C" means A or B or C or AB or AC or BC or ABC (i.e., A and B and C), or combinations with more than one feature (e.g., AA, AAB, ABBC, etc.).

Further, an indication that information is sent or transmitted, or a statement of sending or transmitting information, "to" an entity does not require completion of the communication. Such indications or statements include situations where the information is conveyed from a sending entity but does not reach an intended recipient of the information. The intended recipient, even if not actually receiving the information, may still be referred to as a receiving entity, e.g., a receiving execution environment. Further, an entity that is configured to send or transmit information "to" an intended recipient is not required to be configured to complete the delivery of the information to the intended recipient. For example, the entity may provide the information, with an indication of the intended recipient, to another entity that is capable of forwarding the information along with an indication of the intended recipient.

Substantial variations may be made in accordance with specific requirements. For example, customized hardware might also be used, and/or particular elements might be implemented in hardware, software (including portable software, such as applets, etc.) executed by a processor, or both. Further, connection to other computing devices such as network input/output devices may be employed.

The systems and devices discussed above are examples. Various configurations may omit, substitute, or add various procedures or components as appropriate. For instance, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations provides a description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of operations may be undertaken before, during, or after the above elements are considered. Accordingly, the above description does not bound the scope of the claims.

Further, more than one invention may be disclosed.

The invention claimed is:

1. A dual-polarization, millimeter-wave antenna system in a mobile device having a top surface, a bottom surface, and an edge surface, the antenna system comprising:

a first antenna element configured to radiate energy, in a millimeter-wave frequency band, outwardly from the edge surface with a first polarization;

a second antenna element configured to radiate energy, in the millimeter-wave frequency band, outwardly from the edge surface with a second polarization substantially perpendicular to the first polarization; and a front-end circuit coupled to the first antenna element and the second antenna element and configured to provide first outbound signals to the first antenna element for radiation, to provide second outbound signals to the second antenna element for radiation, to receive first inbound signals from the first antenna element, and to receive second inbound signals from the second antenna element;

wherein the second antenna element is disposed between the first antenna element and the top surface, or between the first antenna element and the bottom surface, or between the first antenna element and the top surface and between the first antenna element and the bottom surface.

2. The antenna system of claim 1, wherein a longitudinal axis of the second antenna element, parallel to the second polarization, intersects with an area occupied by the first antenna element.

3. The antenna system of claim 1, wherein the first antenna element is a dipole and the second antenna element is a monopole.

4. The antenna system of claim 3, wherein a projection of the monopole along a length of the monopole is centered over a radiating-arms portion of the dipole.

5. The antenna system of claim 3, further comprising a reflecting ground wall disposed inwardly from the monopole relative to the edge surface and configured to reflect energy radiated inwardly from the monopole.

6. The antenna system of claim 3, further comprising an isolating ground plane disposed between a monopole feed, configured and coupled to convey energy to the monopole, and a dipole feed, configured and coupled to convey energy to the dipole.

7. The antenna system of claim 6, wherein the monopole feed, the dipole feed, and the isolating ground plane are each disposed in a respective layer of a printed circuit board.

8. The antenna system of claim 3, wherein the dipole and the monopole comprise portions of a stepped member, the stepped member comprising a printed circuit board, with the dipole extending from an edge of a ground plane of the printed circuit board, and a stepped section, with the monopole disposed in the stepped section and extending away from the dipole.

9. The antenna system of claim 8, wherein the stepped member further includes a ground wall disposed substantially parallel to the monopole.

10. A dual-polarization, millimeter-wave antenna system in a mobile device having a top surface, a bottom surface, and an edge surface, the antenna system comprising:

first radiating means for radiating energy, in a millimeter-wave frequency band, outwardly from the edge surface with a first polarization;

second radiating means for radiating energy, in the millimeter-wave frequency band, outwardly from the edge surface with a second polarization substantially perpendicular to the first polarization; and radio-frequency circuit means, coupled to the first radiating means and the second radiating means, for providing first outbound signals to the first radiating means for radiation, for providing second outbound signals to the second radiating means for radiation, for receiving first inbound signals from the first radiating means, and for receiving second inbound signals from the second radiating means;

wherein the second radiating means are disposed between the first radiating means and the top surface, or between the first radiating means and the bottom surface, or between the first radiating means and the top surface and between the first radiating means and the bottom surface.

11. The antenna system of claim 10, wherein the first radiating means comprise a dipole and the second radiating means comprise a monopole.

12. The antenna system of claim 11, wherein a projection of the monopole along a length of the monopole is centered over a radiating-arms portion of the dipole.

13. The antenna system of claim 11, further comprising reflecting means, disposed inwardly from the monopole relative to the edge surface, for reflecting energy radiated inwardly from the monopole.

14. The antenna system of claim 10, further comprising isolating means for inhibiting electrical coupling between a first feed for the first radiating means, configured and coupled to convey energy to the first radiating means, and a second feed for the second radiating means, configured and coupled to convey energy to the second radiating means.

15. The antenna system of claim 14, wherein the first feed for the first radiating means, the second feed for the second radiating means, and the isolating means are each disposed in a respective layer of a printed circuit board.

16. A method of sending and receiving dual-polarization, millimeter-wave signals to and from a mobile device having a top surface, a bottom surface, and an edge surface, the method comprising:

radiating energy, in a millimeter-wave frequency band, from a first radiator outwardly from the edge surface with a first polarization;

receiving, via the first radiator, energy in the millimeter-wave frequency band with the first polarization;

radiating energy, in the millimeter-wave frequency band, from a second radiator outwardly from the edge surface with a second polarization substantially perpendicular to the first polarization, the second radiator being disposed between the first radiator and the top surface or the bottom surface, or a combination thereof; and receiving, via the second radiator, energy in the millimeter-wave frequency band with the second polarization.

17. The method of claim 16, further comprising isolating a first feed conveying energy to or from the first radiator from a second feed conveying energy to or from the second radiator.

18. A dual-polarization, millimeter-wave antenna system comprising:

a printed circuit board comprising a substantially planar portion having a length, a width, and a thickness, each of the length and the width being at least two times the thickness;

a dipole extending from a ground plane of the printed circuit board and configured to radiate energy, in a millimeter-wave frequency band, outwardly from an edge of the printed circuit board with a first polarization substantially parallel to a plane defined by the length and the width of the printed circuit board; and a monopole extending in a direction non-parallel to the plane defined by the length and the width of the printed circuit board, the monopole configured to radiate energy, in the millimeter-wave frequency band, outwardly from the printed circuit board with a second polarization non-parallel to the first polarization.

19. The antenna system of claim 18, wherein a longitudinal axis of the monopole intersects with an area of the dipole.

20. The antenna system of claim 18, wherein a projection of the monopole along a length of the monopole overlaps with area occupied by a radiating-arms portion of the dipole.

21. The antenna system of claim 20, wherein the projection of the monopole along the length of the monopole is centered over the radiating-arms portion of the dipole.

22. The antenna system of claim 18, further comprising a reflecting ground wall disposed inwardly from the monopole relative to an edge of the printed circuit board and configured to reflect energy radiated from the monopole.

23. The antenna system of claim 18, further comprising:

a monopole feed, configured and coupled to convey energy to the monopole;

a dipole feed, configured and coupled to convey energy to the dipole; and an isolating ground plane disposed between the monopole feed and the dipole feed.

24. The antenna system of claim 18, wherein the printed circuit board comprises a stepped portion extending away from the substantially planar portion, the stepped portion comprising at least part of the monopole.

25. The antenna system of claim 24, wherein the at least part of the monopole comprises a plurality of vias through a respective plurality of layers of the stepped portion of the printed circuit board.

26. The antenna system of claim 18, wherein the monopole extends in a direction substantially transverse to the plane defined by the length and the width of the printed circuit board.

27. The antenna system of claim 18, wherein the second polarization is substantially perpendicular to the first polarization.

28. The antenna system of claim 18, wherein the monopole is substantially linear.

29. The antenna system of claim 18, wherein the monopole is helical.

30. The antenna system of claim 18, wherein the monopole and the dipole are collocated when viewed from a first direction substantially transverse to the plane defined by the length and the width of the printed circuit board, the monopole and the dipole being spaced apart along the first direction.

* * * * *